US009987198B2

(12) United States Patent
Finney

(10) Patent No.: US 9,987,198 B2
(45) Date of Patent: Jun. 5, 2018

(54) DISPOSABLE LIQUID-CONTAINING PACIFIER AND A MULTI-PACK OF SAME

(71) Applicant: Claudia Finney, West Chester, OH (US)

(72) Inventor: Claudia Finney, West Chester, OH (US)

( * ) Notice: Subject to any disclaimer, the term of this patent is extended or adjusted under 35 U.S.C. 154(b) by 551 days.

(21) Appl. No.: 13/904,268

(22) Filed: May 29, 2013

(65) Prior Publication Data

US 2014/0296915 A1 Oct. 2, 2014

Related U.S. Application Data

(60) Provisional application No. 61/807,486, filed on Apr. 2, 2013.

(51) Int. Cl.

| | |
|---|---|
| ***A61J 17/00*** | (2006.01) |
| ***A61J 7/00*** | (2006.01) |
| *A61J 9/00* | (2006.01) |

(52) U.S. Cl.

CPC ..... *A61J 17/006* (2015.05); *A61J 7/0053* (2013.01); *A61J 9/00* (2013.01); *A61J 9/005* (2013.01); *A61J 17/00* (2013.01); *A61J 17/001* (2015.05)

(58) Field of Classification Search

None

See application file for complete search history.

(56) References Cited

U.S. PATENT DOCUMENTS

| | | | | |
|---|---|---|---|---|
| 2,014,236 | A | | 9/1935 | McNamara |
| D227,512 | S | | 6/1973 | Kantz |
| 3,838,784 | A | | 10/1974 | Barton et al. |
| D235,930 | S | | 7/1975 | Cone, II |
| 4,078,566 | A | | 3/1978 | Urban, Jr. |
| 4,228,908 | A | * | 10/1980 | Tweeton ..... 215/11.6 |
| 4,637,934 | A | | 1/1987 | White |
| 4,716,902 | A | | 1/1988 | Swartz |
| D302,940 | S | | 8/1989 | Ferrero |
| 4,898,291 | A | | 2/1990 | Sailors |
| 5,123,915 | A | | 6/1992 | Miller et al. |
| 5,193,675 | A | * | 3/1993 | Otis ..... A45C 3/12 190/16 |
| 5,354,274 | A | | 10/1994 | Demeter et al. |
| 5,366,481 | A | * | 11/1994 | Zade ..... A61J 17/00 606/234 |

(Continued)

OTHER PUBLICATIONS

International Search Report and Written Opinion in corresponding International Application No. PCT/US2014/032486, dated Mar. 6, 2015, 7 pgs.

*Primary Examiner* — Robert Lynch

(74) *Attorney, Agent, or Firm* — Wood Herron & Evans LLP

(57) ABSTRACT

A multi-pack of disposable, liquid-containing pacifiers includes a plurality of pacifiers and an outer packaging containing the plurality of pacifiers therein. Each pacifier includes a bulb containing liquid, a nipple operatively coupled to a proximal end of the bulb, the nipple having an aperture located at a proximal end thereof, and a valve coupled to a proximal end of the bulb, the valve defining open and closed positions. The valve is configured to move to the open position when a pressure is applied to at least one of the nipple and bulb, so as to allow at least a portion of the liquid to flow from the bulb to the nipple.

8 Claims, 4 Drawing Sheets

(56) References Cited

U.S. PATENT DOCUMENTS

| | | | | |
|---|---|---|---|---|
| 5,383,906 | A | 1/1995 | Burchett et al. | |
| 5,402,810 | A * | 4/1995 | Donley | 134/135 |
| 5,419,447 | A | 5/1995 | Lim | |
| 5,606,871 | A * | 3/1997 | Hansen et al. | 62/457.5 |
| 5,620,462 | A | 4/1997 | Valenti | |
| 5,662,684 | A | 9/1997 | Caso | |
| 5,700,279 | A | 12/1997 | Blando | |
| 5,728,137 | A | 3/1998 | Anderson-Fignon | |
| 5,772,685 | A | 6/1998 | Crowe et al. | |
| 6,209,786 | B1 * | 4/2001 | Yelton | B65D 5/5405 229/120.38 |
| 2004/0044367 | A1 * | 3/2004 | Yancy | A61J 17/00 606/234 |
| 2004/0226905 | A1 * | 11/2004 | Diniaco | 215/11.1 |
| 2006/0155331 | A1 | 7/2006 | Bohmer | |
| 2008/0177305 | A1 | 7/2008 | Vath et al. | |
| 2011/0046671 | A1 | 2/2011 | Okoturo | |
| 2012/0022446 | A1 * | 1/2012 | Desai et al. | 604/77 |

* cited by examiner

DISPOSABLE LIQUID-CONTAINING PACIFIER AND A MULTI-PACK OF SAME

CROSS REFERENCE TO RELATED APPLICATIONS

Pursuant to 37 CFR § 1.78(a)(4), this application claims the benefit of and priority to prior filed co-pending Provisional Application Ser. No. 61/807,486, filed Apr. 2, 2013, which is expressly incorporated herein by reference in its entirety.

TECHNICAL FIELD OF THE INVENTION

This invention relates to a pacifier, and more particularly to a pacifier containing liquid.

BACKGROUND OF THE INVENTION

Traditionally, pacifiers, also known as binkies, solely serve a soothing function for babies. In order to deliver liquids to a baby, a separate bottle is used.

Although certain liquid-containing pacifiers have been developed, these pacifiers are typically intended as a reusable product due to the design and cost of materials used. For example, many liquid-containing pacifiers are designed to be filled by the user and to be reused multiple times. Having to refill a pacifier may be inconvenient and/or unsanitary. Moreover, because current liquid-containing pacifiers are intended to be reusable, they are sold as individual units.

SUMMARY OF THE INVENTION

The invention of this application comprises a disposable, liquid-containing pacifier. The pacifier includes a bulb that is sold pre-filled with liquid, a guard, and a nipple portion. The bulb may be any desired shape and/or size to appeal to young children. Young children and parents may find it easier to administer liquid to the child. The one-time use, disposable nature of the pacifier is convenient and sanitary. The pacifier may be sold in a multi-pack. A multi-pack may be easily stored in a freezer or refrigerator.

These and other advantages of the present invention will more readily become apparent from the description of the drawings herein, in which:

DETAILED DESCRIPTION OF THE INVENTION

Figure 1:
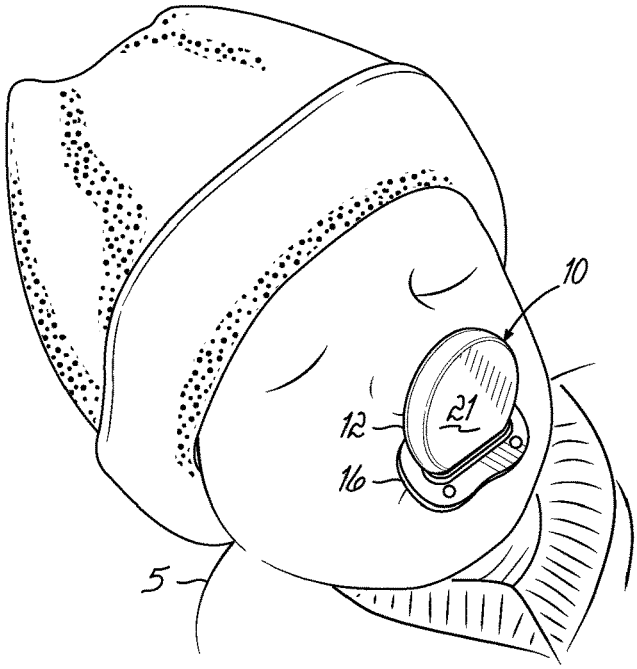
FIG. 1 is a perspective view of a pacifier in use, according to aspects of the present invention.
Figure 2:
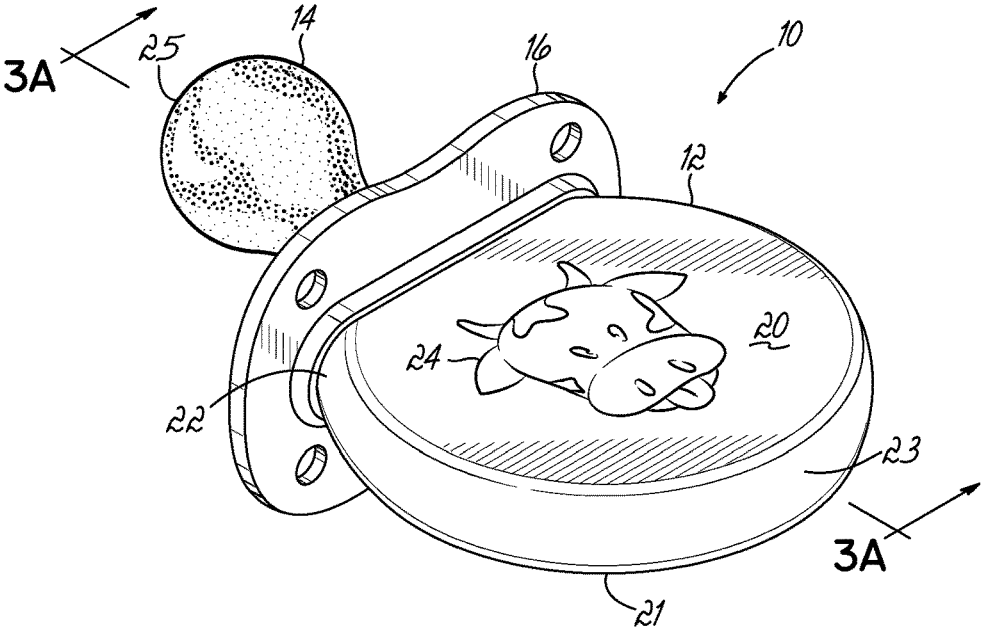
FIG. 2 is a perspective view of the pacifier of FIG. 1.
Figure 3A:
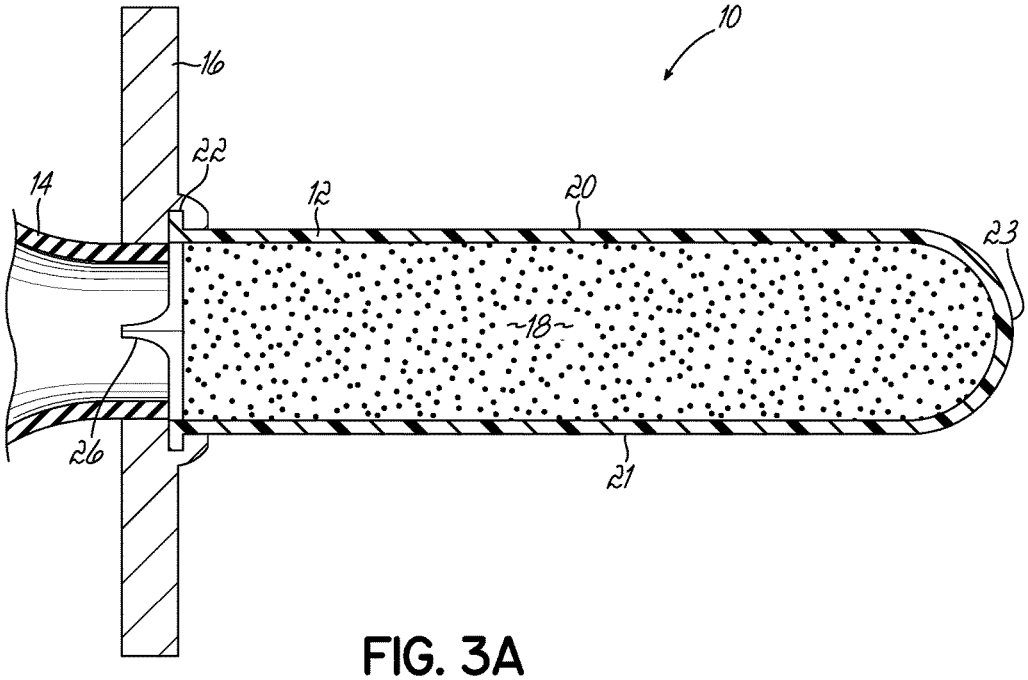
FIG. 3A is a cross-sectional view of the pacifier of FIG. 2 taken along line 3A-3A.
Figure 3B:
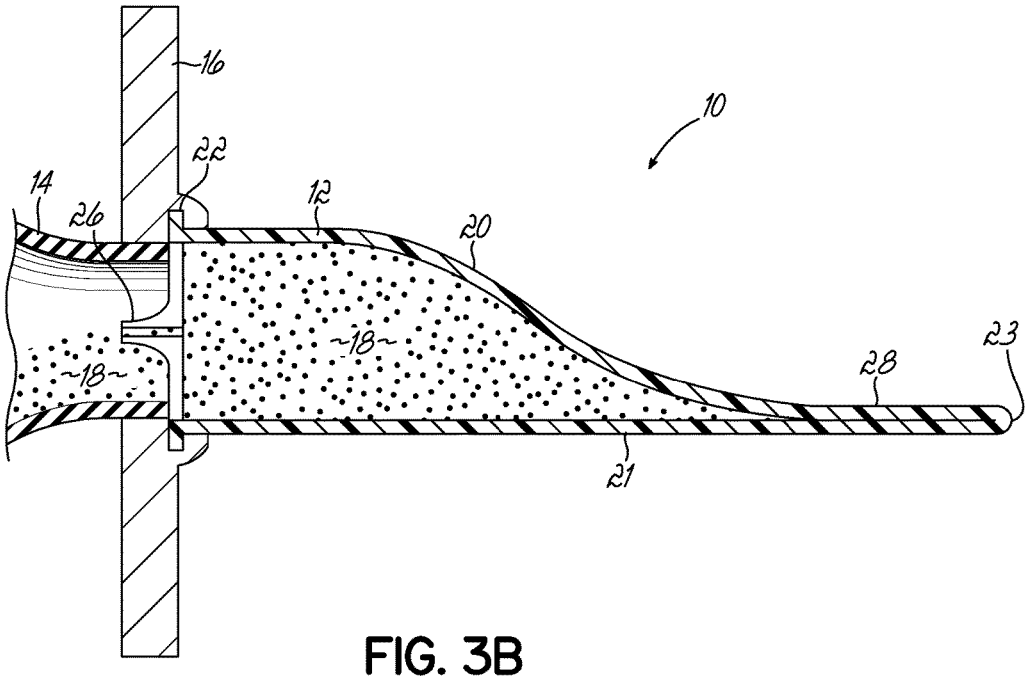
FIG. 3B is a cross-sectional view of the pacifier of FIG. 2 taken along the line 3A-3A, after being partially emptied.

Referring to FIGS. 1 and 2, a pacifier 10 according to the present invention has a bulb 12, a nipple 14, and a guard 16 positioned intermediate the bulb and the nipple. The bulb 12 is configured to contain approximately two ounces of liquid 18 therein (FIGS. 3A and 3B). One of ordinary skill will recognize, however, that the quantity of liquid 18 inside the bulb 12 before use may vary. The liquid may include Similac®, juice, or any other suitable liquid for children, such as infants and/or toddlers. FIG. 1 shows a child 5 using the pacifier 10.

Prior to use, the bulb 12 may have a generally circular or disc-like shape having one or more generally planar surfaces 20, 21. The bulb has a proximal end 22 and a distal end 23. In this invention, the bulb 12 of the pacifier 10 serves at least two purposes: containing liquid therein for the child 5 to consume and providing a handle for the child 5 or care giver to grasp.

At least one of the planar surfaces 20, 21 may have a design 24 thereon. In the embodiment shown, the design 24 is a picture of a cow. One of ordinary skill will recognize that any design 24 may be used on the bulb 12. The design 24 may be integrally formed with the bulb 12, for example, by molding or stamping. In an alternative embodiment, the design 24 may comprise a sticker that is adhered to the bulb 12. Although one configuration of the bulb 12 is illustrated, the bulb 12 may comprise any of variety of shapes and/or sizes. Preferably, the bulb 12 is easy to hold and has a volume sufficient to hold a requisite quantity of liquid for the intended purpose. For example, rather than having a design 24, the bulb 12 may be shaped as a character, such as a cow or other farm animal. Such designs 24 or shapes of the bulb 12 may entertain and/or sooth the child 5. The bulb 12 may be composed of plastic or another semi-flexible material. Preferably, the material should be inexpensive.

A nipple 14 is operatively coupled to the bulb 12 at the proximal end 22 thereof. The nipple 14 may be integrally connected to the bulb 12, for example by being molded or adhered together, such that the nipple 14 and the bulb 12 form a single unit that is not intended to be separated. The nipple 14 has an aperture (not shown) located at a proximal end 25 of the nipple 14. Liquid 18 may be released into the child's mouth through the aperture. The pacifier 10 may use a standard nipple for a bottle.

A guard 16 may be coupled to the bulb 12 and/or the nipple 14 adjacent the proximal end 22 of the bulb 12. The guard 16 may be of a size sufficient to help prevent the child 5 from swallowing or choking on the pacifier 12.

With reference now to FIGS. 3A and 3B, and specifically to FIG. 3A, the pacifier 10 may be sold with the bulb 12 pre-filled with liquid 18. As noted above, the liquid 18 may comprise Similac® or juice, for example. A valve 26 may be positioned adjacent the proximal end 22 of the bulb 12 so as to prevent the liquid 18 from flowing into the nipple 14 until the pacifier 10 is in use. When a child 5 sucks on the nipple 14, however, the resulting pressure causes the valve 26 to open, as shown in FIG. 3B. In an embodiment, the valve 26 may also be opened by compressing or squeezing the bulb 12. Once the valve 26 opens, liquid 18 may flow into the nipple 14. The valve 26 may be configured so as to remain open after an initial pressure is applied. Alternatively, the valve 26 may close and reopen each time suction is released and applied, respectively.

As noted above, the bulb 12 may be formed of a plastic or semi-flexible material. In this way, at least a portion 28 of the bulb 12 may at least partially collapse inwardly when liquid 18 is removed from the bulb 12, as shown in FIG. 3B. The collapsing of the bulb 12 may help reduce an amount of air ingested by the child 5.

In general, the pacifier 10 is intended to be a single-use device. In this way, once the liquid 18 is partially or entirely removed from the bulb 12 or the child 5 is otherwise finished being soothed or entertained by the pacifier 10, the pacifier 10 may be discarded. The bulb 12 of the pacifier 10 is not intended to be re-filled with liquid for repeated use. For this reason, the materials from which the pacifier 10 is manufactured should be inexpensive due to the disposable nature of pacifier 10.

Figure 4:
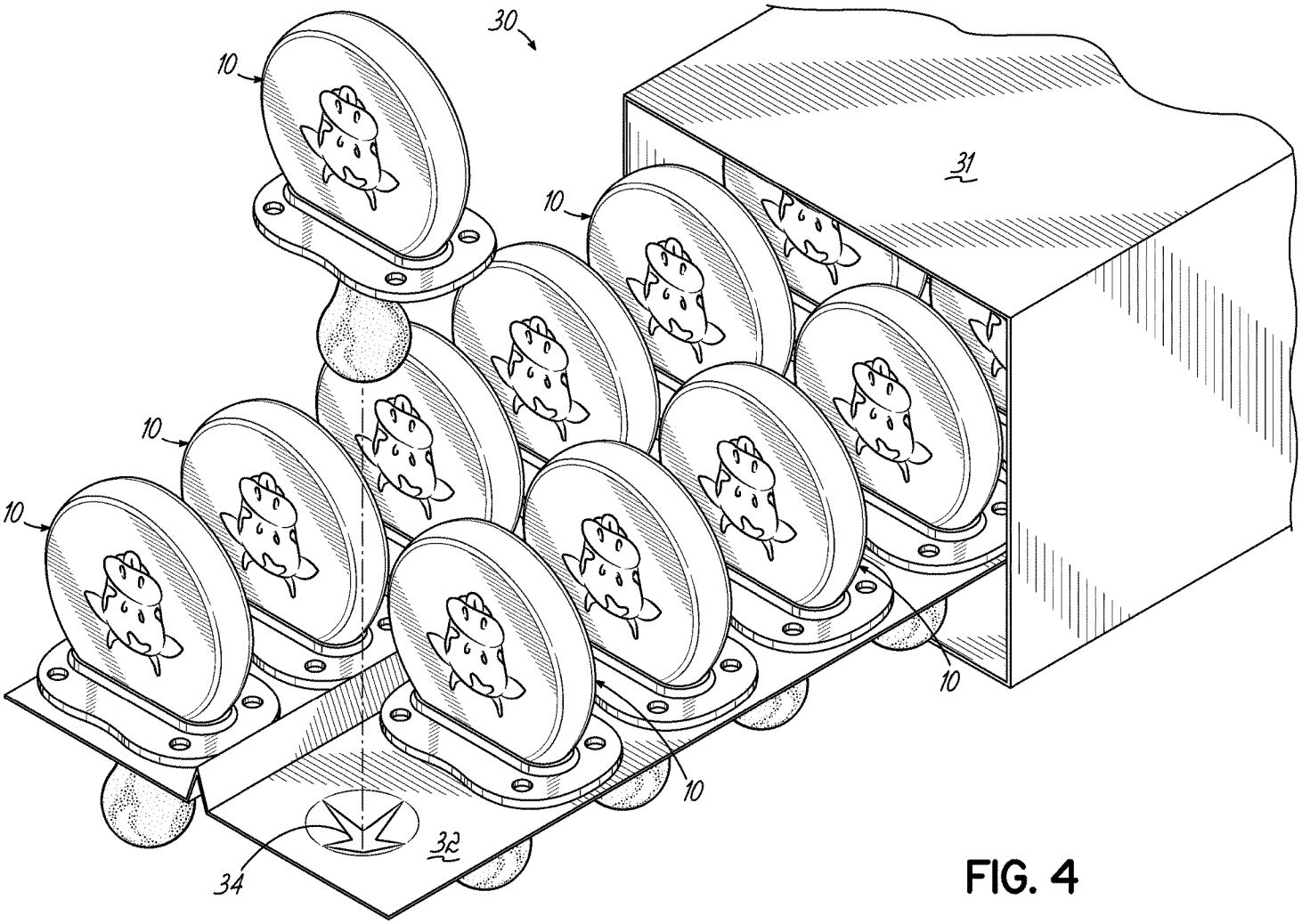
FIG. 4 is a perspective view of a portion of a multi-pack having a plurality of the pacifiers of FIG. 2.

With reference now to FIG. 4, because each pacifier 10 is intended for a single use, it may be desirable to purchase a plurality of pacifiers 10 in a multi-pack 30. In the embodiment shown, the pacifiers 10 are sold as a 12-pack. However, any number of pacifiers 10 may be sold in the multi-pack 30 packaged in an outer packaging 31. For example, the multi-pack 30 may include only six pre-filled pacifiers 10. The pacifiers 10 may be removably coupled to a retaining member 32, such as a sheet of cardboard or plastic that is housed within the outer packaging 31. More specifically, the retaining member 32 may have a plurality of apertures 34 formed therein. The size and shape of the apertures 34 may generally correspond to the size and shape of the nipple 14. In this way, the nipple 14 may be extended through the aperture 34 so as to retain the pacifier 10 in the retaining member 32. Alternatively, the pacifiers 10 may be contained in the outer packaging 31 by any means that helps prevent the bulbs 12 from being compressed or liquid 18 being released from the nipples 14.

The outer packaging 31, as well as the intended single-use of the pacifiers 10, helps to ensure that each time a child 5 is given a pacifier 10, the pacifier 10 is sterilized (or uncontaminated).

Figure 5:
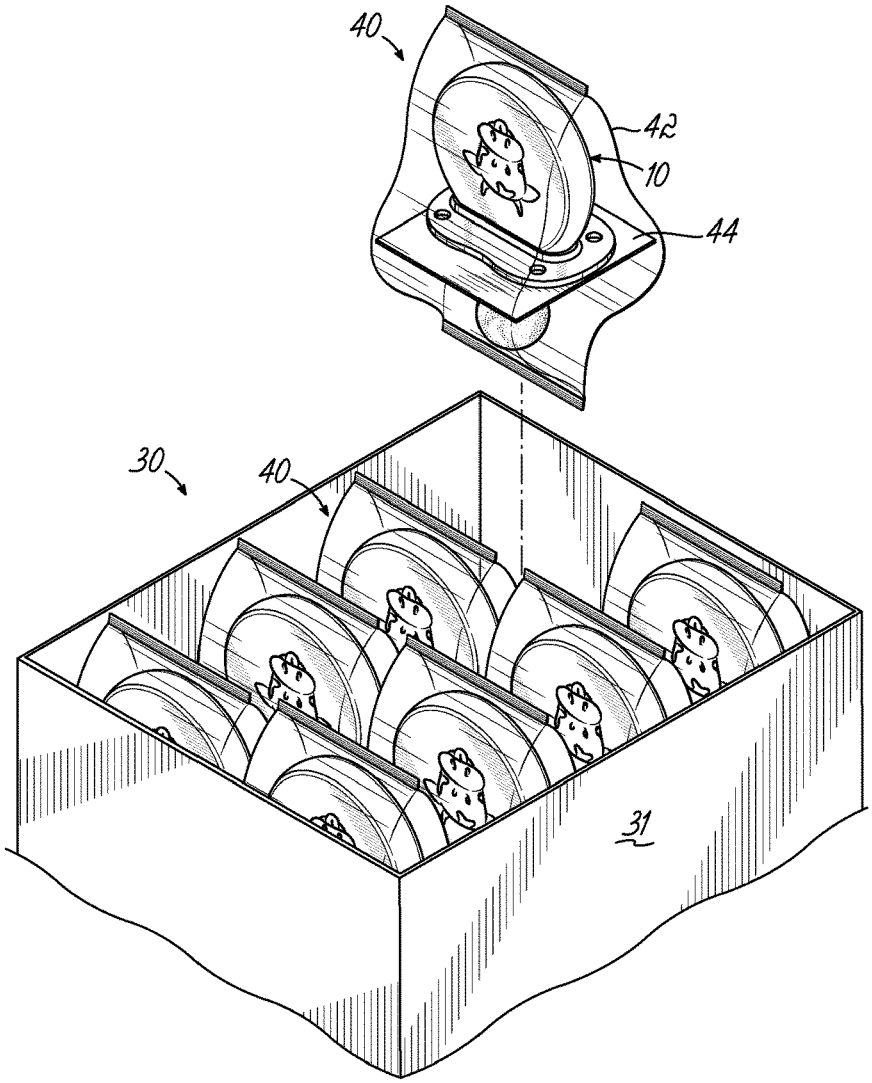
FIG. 5 is a perspective view of a portion of a multi-pack having a plurality of the pacifiers of FIG. 2 that are individually wrapped.
Figure 6:
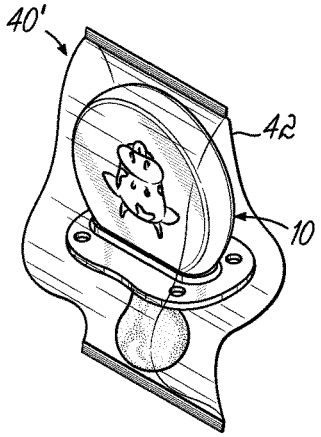
FIG. 6 is a perspective view of an individually wrapped pacifier of FIG. 2.

With reference now to FIGS. 5 and 6, the pacifiers 10 may be sold as individually-wrapped units 40, 40'. The pacifier 10 of each individually-wrapped unit 40, 40' may be enclosed in packaging 42. As shown in FIG. 5, for individually-wrapped member 40, the pacifier 10 may be removably coupled to an individual retaining member 44 prior to being enclosed in the packaging 42. The retaining member 44 operates in the same way as the retaining member 32, except that the retaining member 44 includes a single aperture (not shown) for securing a single pacifier 10 therein. Alternatively, as shown in FIG. 6, the pacifier 10 may be enclosed in packaging 42 without a retaining member 44 as part of the individually-wrapped unit 40'. With either embodiment of the individually-wrapped units 40, 40', a single pacifier 10 may be carried for use "on the go," and the pacifier 10 may be more satisfactorily maintained in its sterilized state.

A plurality of pacifiers 10 may be sold as a multi-pack 30 of individually-wrapped units 40, 40' contained within outer packaging 31. In the embodiment shown in FIG. 5, the pacifiers 10 are sold as an 8-pack. However, any number of pacifiers 10 may be sold in the multi-pack 30.

While I have described several preferred embodiments of the present invention, persons skilled in the art will appreciate changes and modifications which may be made without departing from the spirit of the invention. Therefore, I intend to be limited only by the scope of the following claims and equivalents thereof:

I claim:

1. A multi-pack of liquid-containing pacifiers, the multi-pack comprising:

a plurality of individually wrapped pacifiers, each pacifier being intended for a single use and comprising:

a bulb containing liquid;

a nipple coupled to a proximal end of the bulb, the nipple having an aperture located at a proximal end thereof;

a guard positioned intermediate the bulb and the nipple, the guard being coupled to one of the bulb and nipple; and a valve coupled to a proximal end of the bulb, the valve defining open and closed positions, wherein the valve is configured to move to the open position when a pressure is applied to at least one of the nipple and bulb, so as to allow at least a portion of the liquid to flow from the bulb to the nipple;

for each pacifier, a generally planar, retaining member removable from the pacifier, the retaining member having an aperture at the center of the retaining member, the nipple of the pacifier extending through the aperture in the retaining member and the guard of the pacifier abutting the retaining member;

flexible packaging surrounding each pacifier and retaining member to create an individually wrapped unit, the flexible packaging being capable of deforming to the shape of the pacifier and retaining member; and an outer package surrounding the individually wrapped units.

2. The multi-pack of claim 1, wherein the nipple is integrally connected to the bulb.

3. The multi-pack of claim 1, wherein the outer package is rectangular in shape.

4. The multi-pack of claim 1, wherein the bulb has a generally circular shape.

5. The multi-pack of claim 1, wherein the bulb has at least one generally planar surface.

6. The multi-pack of claim 1, wherein the bulb has a design integrally formed thereon.

7. The multi-pack of claim 6, wherein the design is of an animal.

8. The multi-pack of claim 1, wherein the bulb contains approximately two ounces of liquid.

* * * * *